United States Patent [19]

Cochran

[11] Patent Number: 4,573,327

[45] Date of Patent: Mar. 4, 1986

[54] FLUID FLOW CONTROL SYSTEM

[76] Inventor: Robert Cochran, 5404 Sunset Way N., Lakeland, Fla. 33805

[21] Appl. No.: 652,849

[22] Filed: Sep. 21, 1984

[51] Int. Cl.[4] ..... F25B 27/00

[52] U.S. Cl. ..... 62/238.6; 62/503; 62/504

[58] Field of Search ..... 62/503, 504, 238.6

[56] References Cited

U.S. PATENT DOCUMENTS

| | | | |
|---|---|---|---|
| 1,958,087 | 5/1934 | Hoffman | 62/504 X |
| 2,512,869 | 6/1950 | McBroom | 62/503 X |
| 3,226,940 | 1/1966 | Jekat et al. | 62/504 X |
| 3,315,481 | 4/1967 | Check et al. | 62/504 X |
| 3,499,296 | 3/1970 | Osborne | 62/504 X |
| 4,091,994 | 5/1978 | Madsen | 62/238.6 X |
| 4,187,695 | 2/1980 | Schumacher | 62/503 |
| 4,194,367 | 3/1980 | Lavik | 62/503 X |
| 4,320,630 | 3/1982 | Uselton et al. | 62/238.6 |
| 4,488,413 | 12/1984 | Bottum | 62/503 |

*Primary Examiner*—Lloyd L. King

*Attorney, Agent, or Firm*—A. W. Fisher, III

[57] ABSTRACT

A fluid flow control system for use with a heat exchange apparatus which includes a first heat exchange or condensor to extract heat from the heat exchange apparatus, a compressor and a second heat exchange or evaporator to provide heat to the heat exchange apparatus, the fluid flow control system comprises a liquid flow control device operatively coupled between the first and second heat exchanges to regulate the rate of flow of liquid from the first heat exchange to the second heat exchange, separate any vapor from the liquid fed from the first heat exchange to the second heat exchange, and maintain the desired level of liquid in the lower portion of the first heat exchange or condensor, and a vapor flow control device operatively coupled between the second heat exchange and the compressor to regulate the flow of vapor from the second heat exchange to the compressor, separate any liquid from the vapor, and provide for continuous flow of compressor lubricating oil through the vapor flow control device.

31 Claims, 7 Drawing Figures

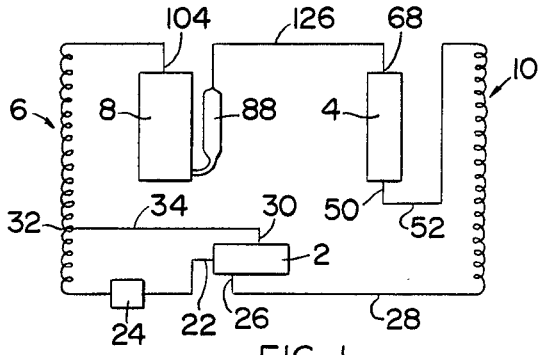
FIG. 1
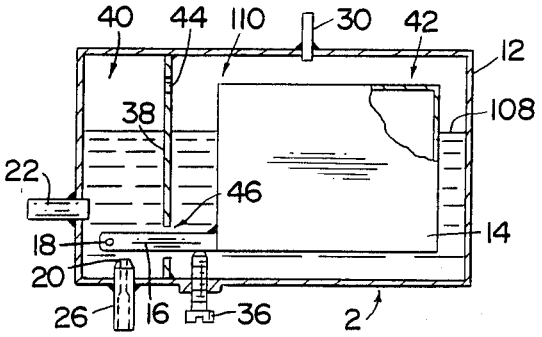
FIG. 2
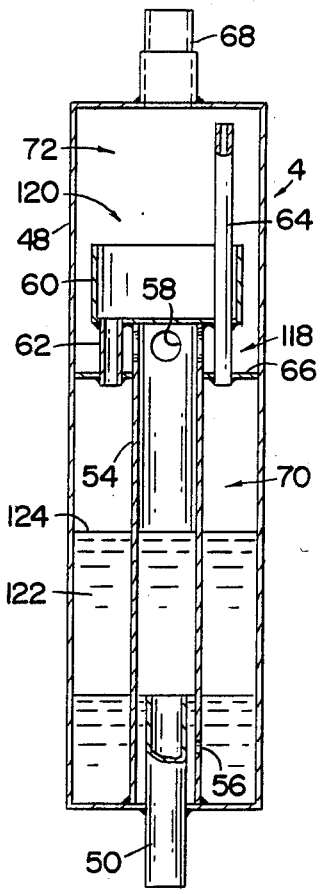
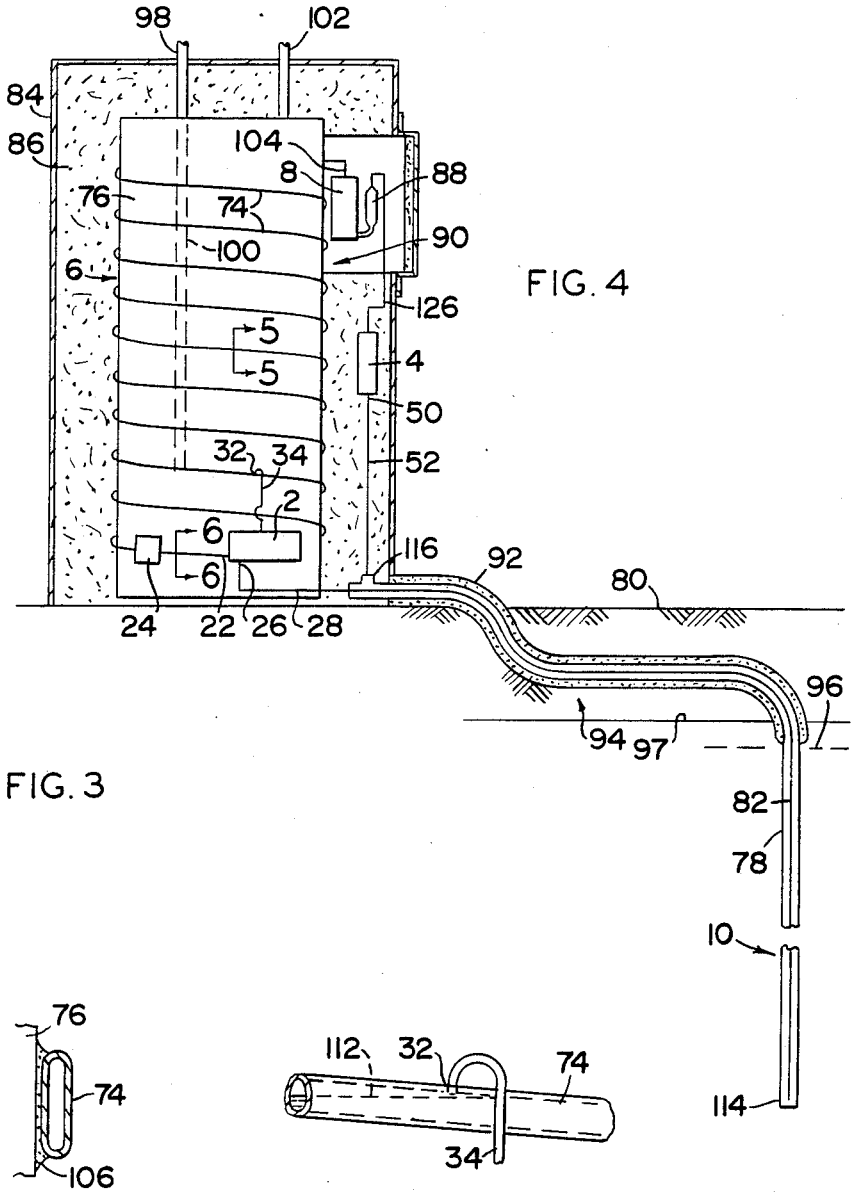
FIG. 4
FIG. 3
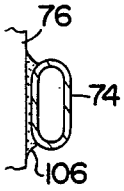
FIG. 5
FIG. 6
FIG. 7

FLUID FLOW CONTROL SYSTEM

BACKGROUND OF THE INVENTION

1. Field of the Invention

A fluid flow control system for use with a heat exchange apparatus, the fluid flow control system comprising a liquid flow control device operatively coupled between the condensor and evaporator and a vapor flow control device operatively coupled between the evaporator and compressor.

2. Description of the Prior Art

Numerous heating and cooling apparatus including condensors, compressors and evaporators have been developed for use with fluorocarbon refrigerants such as Freon. For example, U.S. Pat. No. 3,965,694 discloses an apparatus for heating or cooling including a first heat exchanger to transfer heat between the refrigerant and the atmosphere and a second subterranean heat exchanger to transfer heat between the earth and the refrigerant. A capillary tube restricting device is positioned in the refrigerant line between the first and second heat exchangers to liquefy the refrigerant before it reaches the subterranean heat exchanger. U.S. Pat. No. 2,513,373 discloses a heat pump for heating or cooling a fluid utilizing a closed circuit refrigerant loop. A closed circuit water line circulates water through a pair of subterranean heat exchangers. A heat exchanger which is coupled to both the closed circuit refrigerant loop and the closed circuit water line transfers heat energy between the independent water and refrigerant systems.

U.S. Pat. No. 2,529,154 discloses a solar heating system where water is circulated within a closed system coupled to a solar energy heat absorber while the refrigerant is circulated through a second closed system.

Other examples of the prior art are disclosed in U.S. Pat. Nos. 2,448,315; 2,693,939; 2,968,934; 3,175,370; 3,392,541; 3,564,862; 4,012,920; 4,049,407; France, No. 487762, and Sweden, No. 59350.

In these and in other conventional refrigeration and heat pump systems, superheat at the compressor inlet is poorly controlled or not controlled at all. This is especially true in systems having long evaporators or evaporators with a long time constant such as with ground source heat pumps where the evaporator comprises tubes inserted into the earth and/or water table in the earth.

In conventional ground source heat pumps, conventional thermal expansion valves, and electric expansion valves are subject to "hunting" wherein the superheat at the compressor inlet surges from a very high value such as 25° F. to 35° F., to zero with saturation and possibly "slugging" of the compressor. Use of capillary tubes or "automatic" expansion valves to control the Freon liquid flow requires sizing or adjusting such that saturation and "slugging" the compressor with liquid never occurs, and as a result, superheat runs excessively high during a large portion of the cycle with a corresponding loss of efficiency and tendency to over heat the compressor.

In conventional refrigeration and heat pump apparatus thermal expansion valves, automatic expension valves, electric expansion valves, and capillary tubes all fail to control the liquid Freon flow such that a given portion (bottom) of the condensor remains full of liquid to provide subcooling of the liquid, and prevent blow-through of uncondensed Freon from the condensor.

The subject invention provides such subcooling and blow-through control, with the additional desired result that liquid refrigerant flow from the condensor is at exactly the rate at which the condensor and the entire system is able to produce luqiud condensate.

The failure of conventional devices to properly control liquid flow from the condensor results in poorly controlled liquid flow into the evaporator and poorly controlled vapor flow from the evaporator. In other words, it is very important to control the rate of flow of the refrigerant liquid to the evaporator and refrigerant vapor from the evaporator to maximize vaporazation while minimizing superheating of the refrigerant vapor reaching the compressor. When the refrigerant is not completely vaporized (flow rate through evaporator too fast) the remaining liquid mist (unevaporated Freon) has a cooling or chilling effect on the vapor compressor chamber, drastically reducing efficiency, and can cause damage to the compressor. On the other hand, when the refrigerant is excessively superheated (flow rate through evaporator too slow) the superheated vapor can cause the compressor to overheat, and the compressor has less volumetric efficiency with a resulting loss in system efficiency due to overexpansion of the Freon vapor entering the compressor.

The subject invention provides a constant smooth flow of liquid refrigerant to the evaporator and a constant smooth flow of vapor refrigerant, of low superheat, from the evaporator to the compressor providing an efficient, effective and reliable fluid flow control system.

SUMMARY OF THE INVENTION

The present invention relates to a fluid flow control system comprising a liquid flow control device and vapor flow control device for use in combination with a heat exchange apparatus including a first heat exchange and compressor to extract heat and a second heat exchange to provide heat.

The liquid flow control device comprises an enclosed liquid and vapor reservoir having a liquid metering means disposed therein. The lower or inlet portion of the enclosed reservoir is in open fluid communication with the lower or outlet portion of the first heat exchange or condensor while the upper portion of the reservoir is in open fluid communication with an intermediate point on the first heat exchange generally near the lower end of the first heat exchange. The outlet of the liquid control device formed on the lower portion of the enclosed reservoir is coupled in open fluid communication with the second heat exchange through a liquid conduit.

The liquid metering means comprises a sealed float chamber operatively coupled to an outlet metering orifice such that lowering of the liquid level in the reservoir increasingly restricts flow through the outlet metering orifice while raising the liquid in the enclosed reservoir reduces the restriction of flow through the outlet metering orifice. The liquid level in the reservoir decreases when vapor reaches the intermediate point on the first heat exchange thereby reaching the vapor portion of the reservoir. The liquid level increases when only liquid reaches the intermediate point. Equilibrium is reached when the liquid level in the first heat exchange is at or very near the intermediate point such that a very small flow of refrigerant vapor proceeds continuously from the intermediate point to the upper portion of the enclosed reservoir.

Thus it can be seen that the liquid level in the first heat exchange is held very closely to the desired level, which is the level selected as the intermediate point on the first heat exchange.

It can be seen that the liquid flow control device regulates the rate of liquid flow from the first heat exchange or condensor to the rate that the condensor, compressor and rest of the system is able to produce the liquid. Thus we have a rate of flow exactly in step with the rest of the system. It is a steady rate of flow not subject to "hunting" and other undesired variables.

It should be noted that the conduit providing the open fluid communication between the upper portion of the liquid flow control reservoir and the intermediate point on the first heat exchange may be omitted whenever subcooling of the refrigerant is not desired or not practicable in certain application of the fluid flow control system. When the conduit is omitted refrigerant vapor will reach the upper portion of the enclosed reservoir by an inlet tube and vapor vent whenever condensation of the refrigerant is not quite complete in the first heat exchange. Such uncondensed refrigerant accumulates in the upper portion of the enclosed reservoir thereby causing the liquid level to decrease thereby causing increased restriction to refrigerant flow and restoration of complete, or enar complete, condensation in the first heat exchange. Thus equilibrium is reached with almost complete condensation in the first heat exchange and only a slow trickle of refrigerant vapor into the enclosed reservoir to maintain the balance between liquid and vapor therein. In such application as in all other application, the rate of liquid flow from the liquid flow control device is exactly the rate at which the condensor, compressor and rest of the system is able to produce liquid condensate, and, as in all other applications, no refrigerant vapor is allowed to leave the liquid flow control device.

The vapor flow control device comprises an enclosed liquid and vapor reservoir having liquid trapping, liquid evaporating, and oil ejecting means disposed therein. The lower portion of the enclosed reservoir is in open fluid communication with the outlet of the second heat exchange or evaporator while the upper or outlet portion of the reservoir is in open fluid communication with the inlet of the compressor.

The liquid trapping means comprises a relatively large liquid reservoir operatively coupled to a liquid catcher cup where the fluid flow velocity is greatly reduced by the large cross-sectional area of the flow causing any liquid to fall into the cup and down through a downspout to the enclosed reservoir. Thus any liquid refrigerant entering the vapor flow control device, whether it be a large amount of liquid as may occur immediately upon start up, or small liquid droplets, is trapped in the enclosed reservoir. Under all conditions the vapor leaving the vapor control device is at or near zero superheat.

The liquid evaporating means comprises a vertical evaporating tube directly coupled to the inlet tube at the bottom of the vapor flow control device. The evaporating tube is operatively connected to the liquid reservoir by means of an orifice in the evaporating tube disposed near the bottom of the tube and reservoir such that the liquid level in the reservoir is duplicated in the evaporator tube. The refrigerant charge in the system is such that when the system is running the liquid level in the reservoir, and therefore in the evaporator tube, is always above the top of the entrance tube. Whenever vapor entering at the entrance tube is superheated, meaning the evaporator is not "flooded", the superheated vapor bubbles upward through the liquid standing in the evaporator tube, thereby evaporating some of the liquid, reducing the superheat of the vapor and placing more refrigerant in circulation in the system. This process continues until the evaporator becomes "flooded" and equilibrium is reached when refrigerant vapor at zero superheat and containing no unevaporated refrigerant reaches the vapor flow control device. In the event that the evaporator becomes over-flooded and liquid in form of mist or droplets begins to arrive within the vapor at the inlet of the vapor flow control device, the tiny droplets or mist becomes trapped in the liquid in the evaporating tube, while larger droplets and any liquid surges are trapped at the catcher cup.

The oil ejector means comprises the same components described for the liquid trapping means and liquid evaporating means with a barrier plate beneath and in close proximity with the catcher cup to form, in combination, a foaming chamber. Compressor lubrication oil entrained in the refrigerant vapor and mixed with the liquid refrigerant continuously circulates through the entire system. When the system is operating, the liquid refrigerant standing in the reservoir of the vapor flow control device is always mixed with some amount of oil, which amount tends to increase as oil entrained in the vapor entering the vapor control device is trapped in the liquid refrigerant as it bubbles upward through the evaporating tube. However, the oil concentration increases, a foaming of the oil, in Freon vapor, begins in the evaporating tube and continues in the foaming chamber. The lighter oil-and-vapor foam is entrained in the vapor stream and exits the top of the vapor flow control device. Heavier foam which contains some unevaporated refrigerant falls back into the cup and thence to the reservoir where it is dispersed with the liquid therein.

Thus it can be seen that the vapor flow control device serves to prevent any liquid or unevaporated refrigerant from reaching the compressor, serves as a liquid reservoir to supply the varying refrigerant requirements of the system, serves to evaporate refrigerant as necessary to keep the evaporator flooded and prevent the building of superheat at the compressor entrance, while continuously passing the oil to provide proper lubrication of the compressor.

Working together the liquid flow control device and the vapor flow control device serve to maintain a constant area of condensation in the condensor, maintain a constant area of subcooling in the condensor, regulate the flow of liquid from the condensor smoothly at exactly the rate that the system is able to produce condensate (liquid), prevent any liquid refrigerant from reaching the compressor, maintain the superheat at the compressor inlet at a very low value; maintain exactly the proper charge of refrigerant in circulation at all times so that the evaporator operates continuously as "flooded" evaporator, and provide continuous passage of lubricating oil through the system for the protection of the compressor, all of which features maximize the efficiency of the system.

While the preferred embodiment following herein utilizes the present invention in an application where conventional flow devices cannot function properly, it is to be understood that the present invention will also provide improvement in efficiency in applications where conventional flow devices are normally applied, such as in air conditioning, heat pumps and refrigeration systems, and will greatly simplify many of such applications, especially reverse cycle systems with subcooling.

It is important to note that the liquid flow control device operates in response to only one signal, that signal being a very slow trickle of referigerant vapor from the first heat exchange into the upper portion, or vapor reservoir, of the device. The device requires no pressure or temperature or other feedback signals from other points in the system as do conventional liquid flow control devices. The device is not sensitive to temperature or pressure changes and requires no changing of sensors, orifices or other accessories when changed from use with any common refrigerant to use with another common refrigerant, as is the case with all conventional liquid flow control devices.

Simply stated, an increase in vapor flow to the device, resulting from an inadvertent increase in liquid flow, causes a lowering of the float therein and an increased restriction to liquid flow at the outlet orifice, thereby restoring equilibrium. Conversely a decrease in vapor flow, due to an inadvertent decrease in liquid flow, causes a raising of the float which in turn decreases the restriction to liquid flow at the orifice, thereby restoring the equilibrium.

It should be noted that in certain applications, where the second heat exchange is relatively short, has a relatively constant heat source, and/or where efficiency is not of prime importance, only the liquid flow control device may be used and the vapor flow control device omitted.

BRIEF DESCRIPTION OF THE DRAWINGS

For a fuller understanding of the nature and objects of the invention, reference should be had to the following detailed description taken in connection with the accompanying drawings in which:

FIG. 1 is a schematic view of the fluid flow control system with the heat exchange apparatus.

FIG. 2 is a detailed cross-sectional side view of the liquid flow control device.

FIG. 3 is a detailed cross-sectional side view of the vapor flow control device.

FIG. 4 is a side view of the preferred embodiment of the present invention using an earth source for the heat energy.

FIG. 5 is a detailed cross-sectional view of a portion of the first heat exchange taken along line 5—5 of FIG. 4.

FIG. 6 is a detailed cross-sectional view of the portion of the heat exchange taken along line 6—6 of FIG. 4.

FIG. 7 is a partial detailed view of the intermediate point of the liquid flow control device.

Similar reference characters refer to similar parts throughout the several view of the drawings.

DETAILED DESCRIPTION OF THE PREFERRED EMBODIMENT

As shown in FIG. 1, the present invention relates to a fluid flow control system comprising a liquid flow control device and vapor flow control device generally indicated as 2 and 4 respectively for use in combination with a heat exchange apparatus including a first heat exchange (condensor) to extract heat, compressor and second heat exchange (evaporator) to provide heat generally indicated as 6, 8 and 10 respectively.

As best shown in FIG. 2, the liquid flow control device 2 comprises an enclosed liquid/vapor reservoir 12 having a liquid metering means disposed within. The liquid metering means comprises a sealed hollow float chamber 14, a hinged metering plate or member 16, a stationary hinge pin 18 and a liquid metering orifice 20. Affixed to the reservoir 12 is a first liquid inlet tube or port 22 in open fluid communication with the lower or outlet portion of the first heat exchange 6 through strainer-dryer 24 (FIG. 1). The liquid metering orifice 20 through a second outlet tube or port 26 is in open fluid communication with the second heat exchange 10 through a liquid conduit 28. Also affixed to the reservoir 12 is a vapor inlet tube or port 30 which is in open fluid communication with an intermediate point 32 on the first heat exchange 6 through vapor conduit 34 (FIG. 1). In addition an adjustable metering stop 36 is affixed to the reservoir 12. A vertically disposed liquid/vapor baffle plate 38 separates the reservoir 12 into a liquid receiving chamber 40 and a vapor receiving chamber 42. Vapor vent aperture 44 and liquid metering member aperture 46 are formed in the upper and lower portion of the vertically disposed liquid/vapor baffle plate 38 respectively.

As best shown in FIG. 3, the vapor flow control device 4 comprises an enclosed vertical liquid/vapor reservoir 48 having liquid trapping means, liquid evaporating means, and oil ejecting means disposed therein. The lower portion of the enclosed reservoir 48 is in open fluid communication with the outlet end of the second heat exchange 10 through a vapor/liquid inlet tube or port 50 and vapor conduit 52 (FIG. 1). The liquid trapping, liquid evaporating, and oil ejecting means comprises a vertical evaporating tube 54, including a calibrated inlet orifice 56 and four evaporator tube exit apertures 58, a liquid catcher cup 60, and liquid downspout 62, a vapor vent tube 64, and a liquid/vapor horizontal barrier plate 66. The vapor flow control device 4 is in open fluid communication with the compressor 8 through a vapor outlet tube or port 68, vapor conduit 126 and accumulator 88. The liquid/vapor horizontal barrier plate 66 separates the reservoir 48 into a liquid receiving chamber 70 and a vapor receiving chamber 72.

The preferred embodiment, a geo-thermal earth-source heat pump water heater, as shown in FIG. 4, uses a flattened metal, thermally conductive conduit or tube 74 in intimate thermal contact with a metal water storage tank 76 as the first heat exchange 6, and a metal, thermally conductive liquid/vapor conduit or tube 78 in intimate thermal contact with the earth 80 as the second heat exchange 10. Disposed in co-axial relationship within the tube 78 is a smaller liquid conduit or tube 82 which serves as a conduit to deliver liquid refrigerant to the inlet or lower end of heat exchange 10. Since the liquid conduit or tube 82 is disposed within the liquid/-vapor conduit or tube 78, the heat transferred therebetween forms a third heat exchange 78/82.

The water storage tank 76 is centrally disposed within an outer shell 84 filled with thermal insulation material 86. The liquid flow control device 2, vapor flow control device 4, and strainer-dryer 24 are all embedded within the thermal insulation material 86. A conventional hermetically sealed refrigerant compressor 8 and accumulator 88 are disposed within an air-filled compressor compartment 90, with the compressor 8 disposed in thermal communication with the water storage tank 76 by direct heat radiation and by thermal conduction and thermal convection of the air in the compressor compartment 90. The compressor compartment 90 is otherwise completely surrounded by thermal insualtion 86 to prevent heat loss from the system.

A thermally insulating sheath 92 is concentrically disposed around the second heat exchange 10 generally extending from the water heater shell 84 into and through the length of earth trench 94 and thence downward, typically, to the vicinity of the water table 96 below the bottom 97 of the earth trench 94 in the earth 80. Water to be heated enters the tank 76 through the first inlet or port 98 thence passing through conduit 100 to reach the vicinity of the lower portion of the tank 76 and after being heated by hot refrigerant vapor flowing through the thermally conductive conduit 14 exits at the second outlet or port 102.

As shown in FIG. 5, the thermally conductive conduit or tube 74 is flattened to reduce the refrigerant vapor volume required therein between the compressor outlet 104 and intermediate point 32. The thermally conductive conduit or tube 74 is flattened even further between intermediate point 32 and strainer-dryer 24 to further reduce the volume of liquid refrigerant required in the thermally conductive conduit or tube 74 between point 32 and the strainer-dryer 24. In both degrees of flattening the flattening in conjunction with a thermally conductive filler 106 serves to greatly increase the thermal contact between the thermally conductive conduit or tube 74 and the storage tank 76. It should be noted that the vapor conduit 34 enters the top of the thermally conductive conduit or tube 74 at the intermediate point 32 such that any refrigerant vapor arriving at the intermediate point 32 will be immediately conveyed to vapor inlet tube 30 on the liquid flow control device 2.

In operation, hot compressed refrigerant vapor leaves the compressor 8 through compressor outlet 104 to the first heat exchange tube 74. As the hot vapor progresses through tube 74 it initially transfers its superheat to the storage tank 76 and water within the storage tank 76 by means of the thermal conductivity of thermally conductive conduit or tube 74 and thermally conductive filler 106. This occurs primarily in the upper portion of the first heat exchange 6. The hot vapor then begins to condense to a liquid until the vapor has completed condensing to a liquid as the refrigerant reaches the intermediate point 32 of the thermally conductive conduit or tube 74.

The hot or warm liquid refrigerant passes through the lower portion of the first heat exchange 6, giving up additional heat to the water within the storage tank 76, until the refrigerant arrives at the strainer-dryer 24 in a subcooled state several degrees cooler than when it completed condensing in the vicinity of intermediate point 32. Thus the water within the storage tank 76 has been heated by absorbing the superheat from the vapor, the heat of condensation, and the heat of subcooling of the refrigerant liquid.

As shown in FIGS. 2 and 4, the subcooled liquid refrigerant entering liquid flow control device 2 at the first liquid inlet tube or port 22 and leaving through the liquid metering orifice 20 will be greatly restricted as the sealed hollow float chamber 14 is supported only by the adjustable metering stop 36 with the result that the hinged metering plate or member 16 is in close proximity with liquid metering orifice 20 thus forming a restriction to liquid flow into the liquid metering orifice 20, metering plate 16 comprising a solid flat plane substantially perpendicular to the second liquid outlet tube or port 26, and covering the entire area above the second liquid outlet tube or port 26 and the liquid metering orifice 20. This restriction causes the liquid level 108 in the reservoir 12 to increase and causes a slowing of the liquid flow at the first liquid inlet tube or port 22, the slowed inflow in turn causes an increase of the liquid level in the lower portion of the heat exchange tube 74, until the liquid level 112 is slightly above intermediate point 32.

As liquid level 108 increases, the restriction at the liquid metering orifice 20 decreases due to the raising of the hinged metering plate 16 by the float 14 which in turn causes a lowering of liquid level 112 to slightly below intermediate point 32. However, the liquid level 108 ceases to increase when sufficient refrigerant vapor 110 reaches the upper portion of reservoir 12 through the conduit 34 and vapor inlet or port 30. Equilibrium is reached quickly after start-up of the system when the liquid level 112 as shown in FIG. 7 is at or slightly below the entrance to the conduit 34 at the intermediate point 32.

If the liquid level 112 inadvertantly raises slightly above the intermediate point 32, little or no refrigerant vapor can flow to the upper portion of the reservoir 12. The vapor in the reservoir 12 will then diminish in volume as it slowly but continuously condenses due to its contact with cooler (subcooled) liquid at surface 108/110. Such diminishing volume of vapor plus a small amount of liquid which enters the reservoir 12 through the conduit 34 and inlet 30 causes the float 14 to rise slightly thereby reducing the restriction at the liquid metering orifice 20 and increasing the liquid flow through the liquid flow control device 2, which in turn lowers the liquid level 112 near the intermediate point 32 until vapor flow through the conduit 34 resumes and the original level of 112 has been restored.

Conversely if liquid level 112 inadvertently lowers substantially below the intermediate point 32, a constant flow of vapor from the tube 74 to the reservoir 12 will result. As shown in FIGS. 5 and 6 the cross-sectional area of the thermally conductive conduit 74 decreases at the lower portion of the storage tank 76 as the refrigerant changes from vapor to liquid. Such vapor being of slightly higher pressure than liquid in the reservoir 12 will displace the liquid causing the liquid level 108 to drop slightly thereby lowering the float 14 and the plate 16 and increasing the restriction to flow at the liquid metering orifice 20. Such increased restriction to flow results in a slow liquid flow through the liquid flow control device 2 with the final result that the liquid level 112 will increase until its original level is restored.

Thus it can be seen that the liquid flow control device 2 reaches an equilibrium with the liquid level in the first exchange tube 74 at or very near the intermediate point 32 on the first heat exchange 6. Under these steady-state condition a small steady flow of vapor and a small amount of liquid flows through the conduit 34 to replenish that vapor 110 which condenses in the reservoir 12 above the liquid level 108. It should be noted that the liquid flow control device 2 is completely surrounded by the thermal insulation 86 to reduce the rate of vapor flow through the conduit 34. If the reservoir 12 is unduly cooled by ambient air the condensation rate of the vapor 110 will be increased, especially by virtue of its contact with the upper inner surfaces of the reservoir 12. This increased condensation would cause a substantial amount of the refrigerant to bypass the lower, subcooling, portion of the heat exchange 6, with a corresponding reduction of the benefit of subcooling.

As shown in FIG. 2, the vertical center-line of liquid metering orifice 20 is a very short distance from the horizontal center-line of stationary hinge pin 18 relative to the much greater distance between the vertical center-line of the float 14 and hinge pin 18. This provides a leverage of the floatation force of the float 14, to overcome the downward pull or "suction" which is due to a low pressure area on the under side of metering plate 16 directly above the liquid metering orifice 20 created by liquid 108 at relatively high pressure in the reservoir 12 flowing at high velocity into the much lower pressure in and beyond the metering orifice 20. Without such leverage, the float 14 and reservoir 12 would have to be many times larger.

The adjustable metering stop 36 by vertical movement and adjustment sets the minimum flow rate for any given application of the liquid flow control device 2 and is needed to prevent "hunting" oscillating back and forth from too high a flow rate to too low a flow rate which would be triggered by allowing the flow rate to drop too low, as would happen if the metering plate 16 were allowed to drop far enough to close or almost close the liquid metering orifice 20. It should be noted that the hinged metering plate 16 never actually touches the metering orifice 20, and mechanical wear to the metering means is thereby totally avoided. The stationary hinge pin 18 operates in a mixture of oil and liquid refrigerant and therefore should never have appreciable wear.

The vertically disposed liquid/vapor baffle plate 38 within the reservoir 12 serves to prevent surges upward, downward, or horizontally of liquid level 108 by virtue of relatively small liquid metering member aperture 46, which reduces the rate of which liquid can enter or leave the float chamber 42. The vapor vent apertures 44 near the top of the baffle plate 38 provides equalization of the vapor pressure in the two chambers 40/42 formed by the baffle plate 38. The baffle plate 38 helps to prevent "hunting", and with the adjustable metering stop 36 provides a steady, smooth flow of liquid through the liquid flow control device 2.

As shown in FIG. 4, a constant steady flow of liquid refrigerant leaves liquid flow control device 2 at the outlet tube or port 26 and proceeds through the liquid conduit 28 to the lower or inlet end 114 of the second heat exchange 10 which in this application is an evaporator in the form of an earth tap. Although not essential to this invention the liquid conduit 28 is concentrically disposed inside, the heat exchange or earth tap 10, which gives an added advantage of convenience but more importantly gives the a third heat exchange between the liquid conduit 28 and the otherwise inactive portion of the exchange 10 which extends from the storage tank outer shell to the vicinity of the water table 96.

The third heat exchange serves to evaporate refrigerant in the otherwise inactive portion of the earth tap 10 with the result that heat which otherwise might be lost from the system is retained in the system and the vapor pressure at the exit end of second heat exchange or earth tap exit 116, is kept higher than it would otherwise be.

It should be noted that the thermally insulating sheath 92 has the primary function of eliminating the variables in thermal contact between that portion of second heat exchange 10 and the surrounding soil. It can be seen that extremes of hot and cold weather, and very dry or water soaked soil could change that portion of the earth tap from a very good heat source to a very poor heat source or vice versa. The sheath 92 is constructed of a material that is immune to corrosive soils which could otherwise attach the metallic exchange tube 78.

When the liquid refrigerant in the conduit 28/82 reaches the lower or inlet end 114 of the second heat exchange 10, it proceeds upward inside tube 78 and outside tube 82, evaporating as it proceeds, from the heat energy in the earth and the moisture or water in the earth. Evaporation is largely completed as the refrigerant reaches the vicinity of the lower end of sheath 92 but evaporation continues as above described from tube 28 until evaporation is essentially complete as the refrigerant leaves the earth tap at exit end 116 and proceeds through the vapor conduit 52 to the inlet tube or port 50 of vapor flow control device 4. Under steady-state conditions, the refrigerant entering vapor flow control device 4 is essentially all vapor at zero superheat.

Referring to FIGS. 3 and 4, when the system stands idle, between heating/cooling runs, most of the liquid refrigerant (with compressor lubricating oil mixed therein) stands in the earth tap where it collects due to the fact that this is generally the coolest portion of the system. However, depending upon the amount of time between heating/cooling runs some liquid refrigerant may remain in the vapor flow control device 4 and may stand as high but no higher than the upper end of inlet tube or port 50 as it will drain into the inlet tube or port 50 and may evaporate to a lower level. Upon start up of the system, there will usually be a large amount of liquid refrigerant "sucked up" out of the earth tap 10 and into the vapor flow control device 4. This initial "slug" of liquid proceeds upward through the vertical evaporating tube 54, out through evaporator tube exit apertures 58 and on upward through the oil foaming area 118.

The velocity of the liquid diminishes in steps as it enters the vertical evaporating tube 54, as it enters and passes through the oil foaming area 118, and finally is greatly reduced as it passes the upper edge of the liquid catcher cup 60 all due to the ever-increasing cross-sectional area of its flow. The velocity of the liquid is so slow when it reaches liquid/vapor separation area 120 that it falls into liquid catcher cup 60 and thence downward through liquid downspout 62 and then accumulates in the lower or liquid receiving chamber 70 of the enclosed liquid/vapor reservoir 48. Thus the initial large "slug" of liquid and oil is trapped in vapor flow control device 4. Similarly any other large amount of liquid subsequently arriving at vapor flow control device 4 will be trapped.

Generally, shortly after most of the liquid refrigerant is delivered into the vapor flow control device 4 as described above a large portion of the liquid 122 is evaporated into the system to properly charge the system and supply the refrigerant that will reside as liquid in the lower end of the first heat exchange 6, in the liquid flow control device 2 and in the liquid conduit 28. Heat is provided for such quick evaporation by initially superheated vapor arriving at the vapor/liquid inlet tube or port 50 from the earth tap 10. Such superheated vapor passes upward through vertical evaporator tube 54 and "bubbles" in contact with liquid 122 which enters the vertical evaporator tube 54 through calibrated orifice 56. Such intimate contact between the superheated vapor and liquid refrigerant rapidly evaporates the liquid 122 such that the vapor exiting the vapor flow control device 4 at the vapor outlet tube or port 68 quickly reaches zero or near zero superheat.

When steady-state conditions are reached in the system a stable liquid level 124 is established in vapor flow control device 4. As the temperature of the water in the storage tank 76 increases, the resulting "back pressure" to the compressor 8 from in the first heat exchange 6 increases, which means that more refrigerant occupies the tube 74 at high water temperature than a lower water temperature in the storage tank 76. This varying requirement for refrigerant and all other varying requirements, such as occur also in the earth tap 10, and within the compressor 8, its shell also contains refrigerant vapor of varying pressure are all compensated for by the varying level 124 of liquid 122 in the vapor flow control device 4.

Whenever the system requires more refrigerant "charge" to be in circulation the vapor arriving at inlet or port 50 starts to become superheated. Such superheat causes additional refrigerant to evaporate within the evaporator tube 54 and in effect adds refrigerant "charge" to the system until the evaporator 10 is again "flooded" and the vapor arriving at inlet or port 50 has no superheat.

Conversely, if the amount of "charge" required decreases as when hot water is drawn from the storage tank 76 and replaced with cold water the resulting "overcharge" causes some unevaporated refrigerant like a mist to arrive within the vapor entering tube or port 50. Such unevaporated refrigerant is trapped in the liquid standing in tube 54, or in the event the unevaporated refrigerant droplets are large enough and have sufficient velocity to escape trapping in tube 54, trapping will occur when the droplets reach the area above liquid catcher cup 60 due to the increased cross-sectional area of separation area 120. Such trapping of liquid refrigerant 122 takes it out of circulation and thereby restores the condition of all vapor at zero superheat reaching the vapor flow control device 4 at the tube or port 50.

With the vapor flow control device 4 surrounded with thermal insualtion 86, the vapor flow control device 4, and its liquid and vapor contents all follow closely the temperature of the refrigerant entering at the tube or port 50. With no heat source to vapor flow control device 4 other than the refrigerant itself, which enters at zero superheat, it follows that the vapor exiting at vapor exit 68 must also be at zero superheat. It can be seen that insulation 86 is necessary to the proper operation of vapor flow control device 4.

As previously described, all liquid refrigerant is trapped in vapor flow control device 4, the vapor leaving at exit 68 is at zero superheat and contains no unevaporated refrigerant. The vapor conduit 126, which transports the refrigerant from vapor flow control device 4 to the compressor accumulator 88, is covered with thermally insulating tubing over that portion of conduit vapor 126 that occupies the compressor compartment 90. Similarly, the compressor accumulator 88 is wrapped with the thermal insulation 86. This additional thermal insulation 86 insures that the refrigerant vapor reaches the compressor with very low superheat.

Supplying the compressor 8 with an inlet vapor at very low superheat assures continuous adequate cooling of the compressor and its electric motor and, very importantly, keeps the volumetric efficiency of the compressor 8 at its optimum point due to the denseness of the vapor which has not been expanded by appreciable superheat.

All of the thermal insulation 86 around compressor accumulator 88, conduit 126, vapor flow control device 4, conduit 126 and that portion of sheath 92 above the earth 80 serves to prevent condensation of moisture in the air upon the parts so insulated (note that part of earth tap 10 and sheath 92 will be located typically within a building), thus precluding the problem of "sweating", dripping, and corrosion associated with same.

With reference to FIG. 3, the oil ejecting function of vapor flow control device 4 will be described. It is the nature of conventional hermetically sealed refrigerant compressor 8 to continuously, while in operation, pick up lubricating oil from its oil sump and entrain oil in the vapor stream leaving at the compressor exit. The oil so entrained in the thermal conductive conduit or tube 74 becomes mixed with the liquid refrigerant as the refrigerant condenses. Such refrigerant/oil mixture continues through the first heat exchange 6, liquid flow control device 2, and conduit 28, and as the refrigerant evaporates, while moving upward through earth tap 10 and moving upward through evaporator tube 54, the oil again becomes entrained in the vapor stream. Upon arriving in the liquid filled area 70 of vapor flow control device 4 the oil becomes mixed with the liquid 122 therein.

When the oil in the liquid 122 in area 70 reaches sufficient concentration the vapor passing through area 70 produces oil-film-vapor-center bubbles, which bubbles proceed upward and outward through evaporator tube exit apertures 58. As the bubbles and vapor proceed outward and upward through oil foaming area 118 the bubbles become smaller and much greater in number such that an oil/vapor foam is literally created in the oil foaming area 118. As the foam proceeds into liquid/vapor separation area 120 its velocity is so slowed by the increased cross-sectional area that the heavier bubbles, which carry minute quantities of refrigerant liquid, fall into liquid catcher cup 60 and thence into the liquid receiving chamber 70 of the vapor flow control device 4 by way of liquid downspout 62. The lighter bubbles, being free of refrigerant liquid, are entrained upward into the vapor outlet tube or port 68.

The bubbles falling into the liquid catcher cup 60 and thence to the liquid receiving chamber 70 increase the concentration of oil in the liquid refrigerant 122. The creation of oil/vapor bubbles within the evaporator tube 54 which return to the liquid receiving chamber 70 causes a decrease of the liquid level in the evaporator tube 54 and an increase in the liquid level 124 which in turn causes a flow of liquid/oil mix through calibrated orifice 56, with the result that a constant circulation of oil and refrigerant is established within vapor flow control device 4.

The path of circulation is upward from the evaporator tube 54 through apertures 58 through areas 118 and 120, and down through catcher cup 60 and liquid downspout 62, into the liquid receiving chamber 70 and through calibrated inlet orifice 56 and back to the evaporator tube 54. Only the heavier refrigerant-laden bubbles return to create the circulation, while the lighter, liquid free bubbles are carried upward in the vapor stream and returned to the compressor 8 by way of vapor conduit 126 to complete the circuit.

The greater the concentration of oil in mixture 122, the greater the rate of bubble (foam) production, circulation of bubbles, and ejection of lighter bubbles (foam) upward out of area 120. Thus an equilibrium is established wherein the rate of oil exiting the vapor flow control device 4 is the same as the rate of oil entering the vapor flow control device 4, and the concentration of oil in mixture 122 becomes constant.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter language, might be said to fall therebetween.

Now that the invention has been described,

What is claimed is:

1. A fluid flow control system for use with a heat exchange apparatus including a first heat exchange having a conduit disposed in heat exchange relationship relative to a fluid medium to extract heat from the heat exchange apparatus and a second heat exchange to provide heat to the heat exchange apparatus, said fluid flow control system comprising a liquid flow control device operatively coupled between the first and second heat exchange, said liquid flow control device including a liquid metering means operatively disposed within an enclosed liquid/vapor reservoir, said enclosed liquid/vapor reservoir having a liquid port to receive liquid from the first heat exchange and a liquid metering orifice to feed liquid through said enclosed liquid/vapor reservoir formed therein, said liquid metering means comprising a movable flow restrictor disposed relative to said liquid metering orifice such that movement of said movable flow restrictor relative to said liquid metering orifice controls the flow rate of liquid through said liquid metering orifice in response to the liquid level within said enclosed liquid/vapor reservoir to regulate the rate of flow of liquid from the first exchange, separate vapor from the liquid fed from the first exchange and maintain a predetermined level of liquid in the exit portion of the conduit.

2. The fluid flow control system of claim 1 wherein said fluid control device further includes a vapor inlet formed in the upper portion of an enclosed liquid/vapor reservoir, said vapor inlet being in open fluid communication with an intermediate point of the conduit such that vapor arriving at said intermediate point is fed to said upper portion of said enclosed liquid/vapor reservoir displacing liquid within said enclosed liquid/vapor reservoir causing the liquid level therein to decrease thereby reducing the rate of flow of liquid through said liquid metering orifice resulting in a corresponding increase in the liquid level within the conduit resulting in a reduction of flow of vapor from said intermediate point to said enclosed liquid/vapor reservoir causing equilibrium with the liquid level within the conduit adjacent said intermediate point thereby subcooling the liquid.

3. The fluid flow control system of claim 1 wherein said movable flow restrictor comprises a float chamber fixedly attached to a pivotally mounted metering member disposed in movable relationship relative to said liquid metering orifice such that an increase in liquid level in said enclosed liquid/vapor reservoir raises said float chamber to increase flow of liquid through said liquid metering orifice and a decrease in liquid level in said enclosed liquid/vapor reservoir lowers said float chamber to reduce flow of liquid through said liquid metering orifice.

4. The fluid flow control system of claim 3 wherein the distance between the centerline of said point of rotation to the centerline of said float chamber is substantially greater than the distance from the centerline of said point of rotation to the centerline of said liquid metering orifice to provide mechanical leverage of floatation force to offset the relatively low pressure applied to the underside of said metering member due to suction produced at said liquid metering orifice.

5. The fluid flow control system of claim 3 wherein said liquid metering means further include an adjustable stop movably attached to said enclosed liquid/vapor reservoir and disposed relative to said metering member such that the minimum clearance between said metering member and said liquid metering orifice is selectively controlled.

6. The fluid flow control system of claim 1 wherein said liquid metering means further includes a liquid/vapor baffle plate including a metering plate member aperture and a vapor vent hole fixedly attached within said enclosed liquid/vapor reservoir between said float chamber and said liquid port.

7. The fluid flow control system of claim 6 wherein said liquid/vapor baffle plate forms a liquid receiving chamber and a vapor receiving chamber within said enclosed liquid/vapor reservoir.

8. The fluid flow control system of claim 1 further including a vapor flow control device operatively coupled between the second heat exchange and the first heat exchange to regulate the flow of vapor between the second heat exchange, first heat exchange and separate any liquid entrained within the vapor.

9. The fluid flow control system of claim 8 wherein said vapor flow control device comprises an enclosed liquid/vapor reservoir having a vapor/liquid port formed in the lower portion thereof and a vapor port formed in the upper portion thereof, said vapor flow control device including a liquid trapping means, said liquid trapping means comprising a liquid/vapor tube disposed within the lower portion of said enclosed liquid/vapor reservoir and a liquid catcher cup formed on the upper portion of said enclosed liquid/vapor reservoir to receive liquid entrained within the vapor, said liquid catcher cup having the liquid downspout attached to the lower portion thereof to feed liquid therefrom to the lower portion of said enclosed liquid/vapor tube.

10. The fluid flow control system of claim 9 wherein said vapor flow control device further includes a liquid evaporating means comprising an evaporating tube in fluid communication with said vapor/liquid port, said evaporating tube having exit holes formed on the upper portion thereof and formed on the lower portion thereof such that when the liquid level within said evaporator tube is substantially the same as the liquid level within said enclosed liquid/vapor reservoir, vapor reaching said inlet tube passes upward through the liquid in said evaporator tube thereby evaporating some of the liquid in said inlet tube and reducing the superheat of the said vapor.

11. The fluid flow control system of claim 10 wherein said evaporator tube includes a calibrated orifice formed on the lower portion thereof such that vapor may pass from the interior of said vapor tube through said calibrating orifice through said vapor chamber evaporating a portion of the liquid and fed to said vapor chamber through said vapor vent tube.

12. The fluid flow control system of claim 11 wherein said vapor flow control device further includes an oil ejecting means comprising a fixed barrier plate disposed beneath said liquid catcher cup and said exit holes such that the barrier plate and exterior of said liquid catcher cup form an oil foaming chamber such that refrigerant vapor moving upward through the liquid refrigerant in the said evaporator tube will form oil-and-vapor bubbles from oil mixed with the liquid refrigerant and in the vapor, with a resulting production of great numbers of small bubbles, or foam, in said foaming chamber, thus delivering oil-and-vapor foam to the area above said liquid catcher cup allowing the lighter bubbles which contain little or no liquid refrigerant to be entrained in the vapor stream exiting said enclosed liquid/vapor reservoir.

13. The fluid flow control system of claim 12 wherein said liquid trapping means further includes at least one evaporator tube aperture formed in the upper portion of said evaporating tube to feed vapor and liquid to said vapor chamber and a vapor vent extending into said vapor chamber in open communication with said liquid chamber to permit vapor within said liquid chamber to flow to said vapor chamber.

14. The heat exchange apparatus of claim 1 further including a third heat exchange disposed in heat exchange relationship relative to the second heat exchange such that said third heat exchange transfers heat to the second heat exchange through conduction.

15. The heat exchange apparatus of claim 14 wherein said third heat exchange is disposed in coaxial relationship relative to the second heat exchange.

16. A fluid flow control system for use with a heat exchange apparatus including a first heat exchange to extract heat from the heat exchange apparatus and a second heat exchange to provide heat to the heat exchange apparatus, said fluid flow control system comprising a vapor flow control device operatively coupled between the second and first heat exchanges to regulate the flow of vapor between the second and first heat exchanges and separate liquid entrained within the vapor, said vapor flow control device comprises an enclosed liquid/vapor reservoir having a vapor/liquid port formed in the lower portion thereof and a vapor port formed in the upper portion thereof, said vapor flow control device including a liquid trapping means, said liquid trapping means comprising a liquid/vapor tube disposed within the lower portion of said enclosed liquid/vapor reservoir and a liquid catcher cup formed on the upper portion of said enclosed liquid/vapor reservoir to receive liquid entrained within the vapor, said liquid catcher cup having a liquid downspout attached to the lower portion thereof to feed liquid therefrom to the lower portion of said enclosed liqud/vapor tube.

17. The fluid flow control system of claim 16 wherein said vapor flow control device further includes a liquid evaporating means comprising an evaporating tube in fluid communicating with said vapor/liquid port, said evaporating tube having exit holes formed on the upper portion thereof and a liquid inlet orifice formed on the lower portion thereof such that the liquid level within said evaporator tube is substantially the same as the liquid level within said enclosed liquid/vapor reservoir, vapor reaching said inlet tube passes upward through the liquid in said evaporator tube thereby evaporating some of the liquid in said tube and reducing the superheat of the said vapor.

18. The fluid flow control system of claim 17 wherein said vapor flow control device further includes an oil ejecting means comprising a fixed barrier plate disposed beneath said liquid catcher cup and said exit holes such that the barrier plate and exterior of said liquid catcher cup form an oil foaming chamber such that refrigerant vapor moving upward through the liquid refrigerant in the said evaporator tube will form oil-and-vapor bubbies from oil mixed with the liquid refrigerant, with a resulting production of great numbers of small bubbles, or foam, in said foaming chamber, thus delivering oil-and-vapor foam to the area above said liquid retainer cup allowing the lighter bubbles which contain little or no liquid refrigerant to be entrained in the vapor stream exiting said vapor reservoir.

19. The fluid flow control system of claim 18 wherein said liquid trapping means further includes at least one evaporator tube exit aperture formed in the upper portion of said evaporating tube to feed vapor and liquid to said vapor chamber and a vapor vent extending into said vapor chamber in open communication with said liquid chamber to permit vapor within said liquid chamber to flow to said vapor chamber.

20. The fluid control system of claim 16 further including a liquid flow control device operatively coupled between the first and second heat exchanges to regulate the rate of flow of liquid between the first heat exchange and second heat exchange, separate vapor from the liquid fed between the first heat exchange and second heat exchange and maintain a predetermined level of liquid in the lower portion of the first heat exchange.

21. The heat exchange apparatus of claim 16 further including a third heat exchange disposed in heat exchange relationship relative to the second heat exchange such that said third heat exchange transfers heat to the second heat exchange through conduction.

22. The heat exchange apparatus of claim 21 wherein said third heat exchange is disposed in coaxial relationship relative to the second heat exchange.

23. A fluid flow control system for use with a heat exchange apparatus including a first heat exchange to extract heat from the heat exchange apparatus and a second heat exchange to provide heat to the heat exchange apparatus, said fluid flow control system comprising a liquid flow control device operatively coupled between the first and second heat exchanges to regulate the rate of flow of liquid between the first and second heat exchanges, separate vapor from the liquid fed between the first and second heat exchanges and maintain a predetermined level of liquid in the lower portion of the first heat exchange, said liquid floor control device comprises a liquid metering means operatively disposed within an enclosed liquid/vapor reservoir, said enclosed liquid/vapor reservoir having a liquid port to receive liquid from the first heat exchange and a liquid metering orifice to feed liquid from said enclosed liquid/vapor reservoir formed therein, said liquid metering means comprising a movable flow restrictor disposed adjacent said liquid metering orifice such that the movement of said moveable flow restrictor relative to said liquid metering orifice controls the flow rate of liquid through said liquid metering orifice in response to the liquid level within said enclosed liquid/vapor reservoir, said movable flow restrictor comprises a float chamber fixedly attached to a pivotally mounted metering member disposed in movable relationship relative to said liquid metering orifice such that an increase in liquid level in said enclosed liquid/vapor reservoir raises said float chamber to increase flow of liquid through said liquid metering orifice and a decrease in liquid level in said enclosed liquid/vapor reservoir lowers said float chamber to reduce flow of liquid through said liquid metering orifice, the distance between the centerline of said point of rotation to the centerline of said float chamber is substantially greater than the distance from the centerline of said point of rotation to the centerline of said liquid metering orifice to provide mechanical leverage of floatation force to offset the relatively low pressure applied to the underside of said metering member due to suction produced at said liquid metering orifice.

24. The fluid flow control system of claim 23 wherein said liquid metering means further includes a vapor inlet formed in the upper portion of said enclosed liquid/vapor reservoir, said vapor inlet being in open fluid communication with an intermediate portion of the first heat exchange such that vapor arriving at said intermediate portion is fed to said upper portion of said enclosed liquid/vapor reservoir displacing liquid within said enclosed liquid/vapor reservoir causing the liquid level therein to decrease thereby reducing the rate of flow of liquid through said liquid metering orifice resulting in a corresponding increase in the liquid level within the first heat exchange resulting in a reduction of flow of vapor from said intermediate portion of said enclosed liquid/vapor reservoir causing equilibrium with the liquid level within the first heat exchange adjacent said intermediate portion thereby supercooling the liquid.

25. The fluid flow control system of claim 23 further including a vapor flow control device operatively coupled between the second heat exchange and the first heat exchange to regulate the flow of vapor between the second heat exchange and first heat exchange and separate any liquid entrained within the vapor.

26. The fluid flow control system of claim 25 wherein said vapor flow control device comprises an enclosed liquid/vapor reservoir having a vapor/liquid port formed in the lower portion thereof and a vapor port formed in the upper portion thereof, said vapor flow control device including a liquid trapping means, said liquid trapping means comprising a liquid/vapor tube disposed within the lower portion of said enclosed liquid/vapor reservoir and a liquid catcher cup formed on the upper portion of said enclosed liquid/vapor reservoir to receive liquid entrained within the vapor, said liquid catcher cup having the liquid downspout attached to the lower portion thereof to feed liquid therefrom to the lower portion of said enclosed liquid/vapor tube.

27. The fluid flow control system of claim 26 wherein said vapor flow control device further includes a liquid evaporating means comprising an evaporating tube in fluid communication with said vapor/liquid port, said evaporating tube having exit holes formed on the upper portion thereof and formed on the lower portion thereof such that when the liquid level within said evaporator tube is substantially the same as the liquid level within said enclosed liquid/vapor reservoir, vapor reaching said inlet tube passes upward through the liquid in said evaporator tube thereby evaporating some of the liquid in said inlet tube and reducing the superheat of the said vapor.

28. The fluid flow control system of claim 27 wherein said evaporator tube includes a calibrated orifice formed on the lower portion thereof such that vapor may pass from the interior of said vapor tube through said calibrating orifice through said vapor chamber evaporating a portion of the liquid and fed to said vapor chamber through said vapor vent tube.

29. The fluid flow control system of claim 28 wherein said vapor flow control device further includes an oil ejecting means comprising a fixed barrier plate disposed beneath said liquid catcher cup and said exit holes such that the barrier plate and exterior of said liquid catcher cup form an oil foaming chamber such that refrigerant vapor moving upward through the liquid refrigerant in the said evaporator tube will form oil-and-vapor bubbles from oil mixed with the liquid refrigerant and in the vapor, with a resulting production of great numbers of small bubbles, or foam, in said foaming chamber, thus delivering oil-and-vapor foam to the area above said liquid catcher cup allowing the lighter bubbles which contain little or no liquid refrigerant to be entrained in the vapor stream exiting said enclosed liquid/vapor reservoir.

30. The fluid flow control system of claim 29 wherein said liquid trapping means further includes at least one evaporator tube aperture formed in the upper portion of said evaporating tube to feed vapor and liquid to said vapor chamber and a vapor vent extending into said vapor chamber in open communication with said liquid chamber to permit vapor within said liquid chamber to flow to said vapor chamber.

31. A fluid flow control system for use with a heat exchange apparatus including a first heat exchange having a conduit disposed in heat exchange relationship relative to a fluid medium to extract heat from the heat exchange apparatus and a second heat exchange to provide heat to the heat exchange apparatus, said fluid flow control system comprising a liquid flow control device operatively coupled between the first and second heat exchange, said liquid flow control device including means to regulate the rate of flow of liquid from the first heat exchange, separate vapor from the liquid fed from the first exchange and maintain a predetermined level of liquid in the exit portion of the conduit to subcool the liquid therein, said liquid flow control device further includes a vapor inlet formed in the upper portion of an enclosed liquid/vapor reservoir, said vapor inlet being in open fluid communication with an intermediate point of the conduit such that vapor arriving at said intermediate point is fed to said upper portion of said enclosed liquid/vapor reservoir causing the liquid level therein to decrease thereby reducing the rate of flow of liquid through said enclosed liquid/vapor reservoir resulting in a corresponding increase in the liquid level within the conduit resulting in a reduction of flow of vapor from said intermediate point to said enclosed liquid/vapor reservoir causing equilibrium with the liquid level within the conduit adjacent said intermediate point thereby subcooling the liquid.

* * * * *